United States Patent [19]

Hudgins

[11] 4,311,072

[45] Jan. 19, 1982

[54] SPEED HANDLE RATCHET WRENCH

[76] Inventor: James L. Hudgins, Box 807, Cedar Crest, N. Mex. 87008

[21] Appl. No.: 149,687

[22] Filed: May 14, 1980

[51] Int. Cl.[3] ..... B25B 23/14

[52] U.S. Cl. ..... 81/476; 81/57.29

[58] Field of Search ..... 81/476, 477, 467, 57.29

[56] References Cited

U.S. PATENT DOCUMENTS 3,850,055 11/1974 Triplett ..... 81/476

4,086,829 5/1978 Hudgins ..... 81/57.29

FOREIGN PATENT DOCUMENTS 649317 1/1951 United Kingdom ..... 81/476

*Primary Examiner*—James L. Jones, Jr.

*Attorney, Agent, or Firm*—Tilton, Fallon, Lungmus

[57] ABSTRACT

An improved speed handle ratchet wrench that can be used in either of two distinct modes of operation to rotate the drive member at the head end of the wrench. A clutch assembly disposed within the head housing transmits axial rotation of the handle to the drive member below a selected torque load level during the first operating mode, and prevents handle rotation under normal circumstances in response to oscillation of the handle in the second operating mode. The clutch assembly includes a clutch sleeve and a pair of coaxial clutch member having frusto-conical surfaces engagable with the inside surfaces of the sleeve. Torque adjustment is achieved by moving the coaxial members towards or away from each other to vary the frictional engagement between such members and the sleeve.

8 Claims, 4 Drawing Figures

SPEED HANDLE RATCHET WRENCH

BACKGROUND AND SUMMARY

U.S. Pat. No. 4,086,829 discloses a ratchet wrench having a handle which may be turned about its own axis to rotate the transversely-directed head of the wrench, as long as the resistance to head rotation is below a preselected torque load level, to tighten or loosen a nut or other workpiece. The wrench thus has two operating modes: a first mode in which rotation is imparted to the head by turning the handle about its longitudinal axis, and a second mode in which rotation is imparted to the head by oscillating the handle back and forth in a conventional ratchet wrenching operation. The two modes are non-interfering so that, for example, during the ratcheting operation there will be insufficient feedback to cause the handle to twist in the user's hand.

This invention is concerned with a wrench which has the dual operating modes of the wrench of U.S. Pat. No. 4,086,829 but which has important structural differences which yield improved clutch action, increased handle strength, reduced exposure to damage, increased protection against contact by fluids that might adversely affect wrench operation, and significantly lower manufacturing costs.

The improved wrench of this invention has a single-piece handle which is solid throughout substantially its entire length, thereby yielding greater strength and reduced manufacturing costs in comparison with a centrally-bored handle of machined, two-piece construction. The clutch mechanism is disposed within and protected by the head housing, along with other components of the wrench's operating mechanism. Since the handle is formed in one piece and requires no machining or drilling in production, it may be drop-forged for even greater strength and dependability.

In brief, the ratchet wrench includes an elongated handle with a head assembly at one end of that handle, the head assembly comprising a head housing rotatably receiving the end of the handle, a drive member carried by the housing for rotation about an axis transverse to the axis of the handle, and a ratchet-equipped coupling assembly operatively joining the drive member and housing for rotation of the drive member one way or the other about the transverse axis in response to oscillation of the handle. Within the head housing is a clutch assembly which couples the handle and the drive member for simultaneous rotation about their respective axes only below a preselected torque load level. Specifically, the clutch assembly includes a clutch sleeve and a clutch body interposed between and operatively connected to the handle and the drive member, respectively, the sleeve being slidable relative to the clutch body when the preselected torque load level is exceeded. In the disclosed embodiment, the sleeve is provided at opposite ends with a pair of inwardly tapering frusto-conical clutch surfaces and the clutch body takes the form of a clutch nut and a clutch gear having frusto-conical outer surface portions received in the ends of the sleeve and frictionally engaging the tapered surfaces of that sleeve. Adjustable connecting means extend through the sleeve to join the clutch nut and clutch gear for limited axial adjustment while at the same time securing such parts against independent relative rotation. The torque load level may therefore be varied by adjusting the connecting means and the force with which the conical surfaces of the clutch nut and clutch gear engage the sleeve. The sleeve is in turn formed of a tough, durable, but slightly deformable material, such as nylon or other polymeric material having similar characteristics, so that the outward forces exerted upon the sleeve by the clutch nut and clutch gear will cause the sleeve's outer surface to tightly engage the inner surface of the cavity of the handle in which the clutch assembly is located. The adjustable connecting means therefore performs the dual functions of setting the torque load limit of the clutch and locking the sleeve against rotation relative to the handle.

Other features, objects, and advantages will become apparent from the specification and drawings.

DRAWINGS

DETAILED DESCRIPTION

Figure 1:
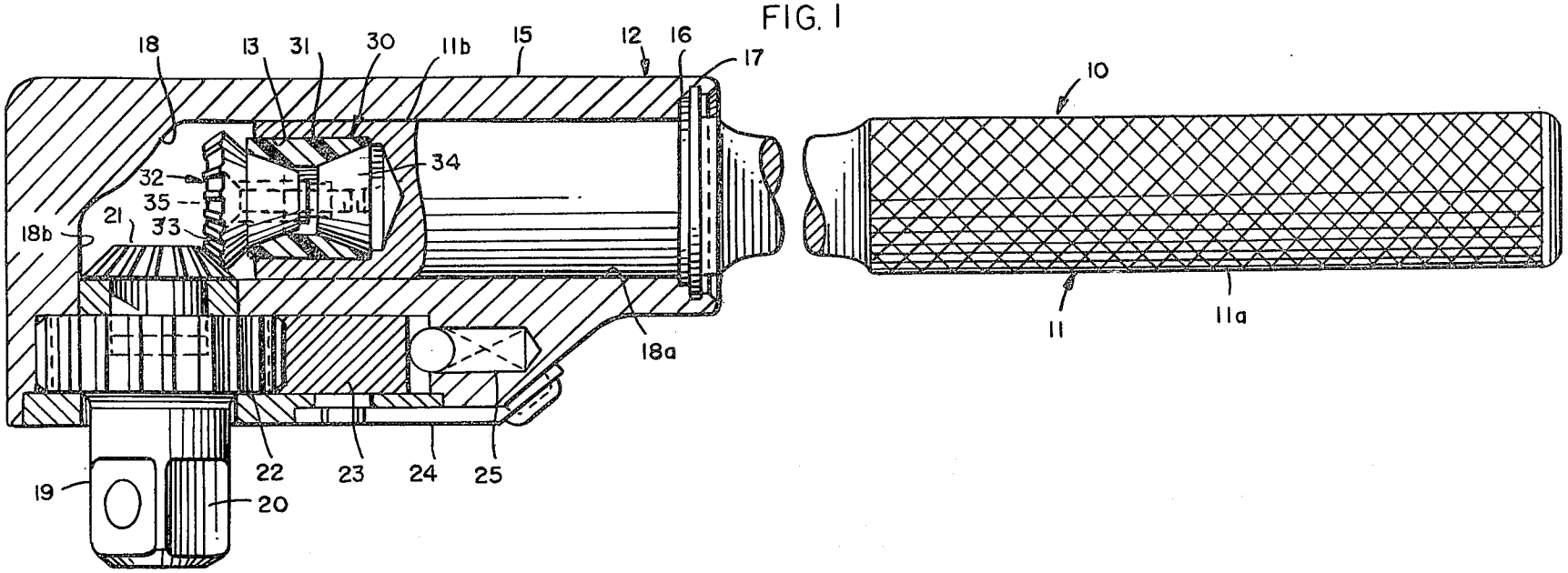
FIG. 1 is a fragmentary side elevational view, taken partly in section, showing the operating mechanism of a wrench embodying the invention.

Referring to the drawings, the numeral 10 generally designates a speed handle ratchet wrench having an elongated handle 11 and a head assembly 12 disposed at one end of the handle. The handle, shown most clearly in FIG. 3, takes the form of a solid and generally cylindrical bar which may have its outer surface knurled at one end 11*a* to provide a non-slipping surface for gripping the handle. The opposite end 11*b* is provided with a recess or cavity 13 and an annular groove 14. The entire end portion 11*b* is received within the housing 15 of the head assembly with retaining rings 16 and 17 being located in groove 14 to retain the end portion 11*b* of the handle within the head housing while at the same time permitting relative rotation of the parts. If desired, for purposes of balance and appearance, the shank portion 11*c* of the handle may be reduced in diameter as illustrated most clearly in FIG. 3. Since the handle is solid, and may be drop-forged for even greater strength, such a reduction in size and weight may be achieved without any objectable reduction in strength.

Figure 2:
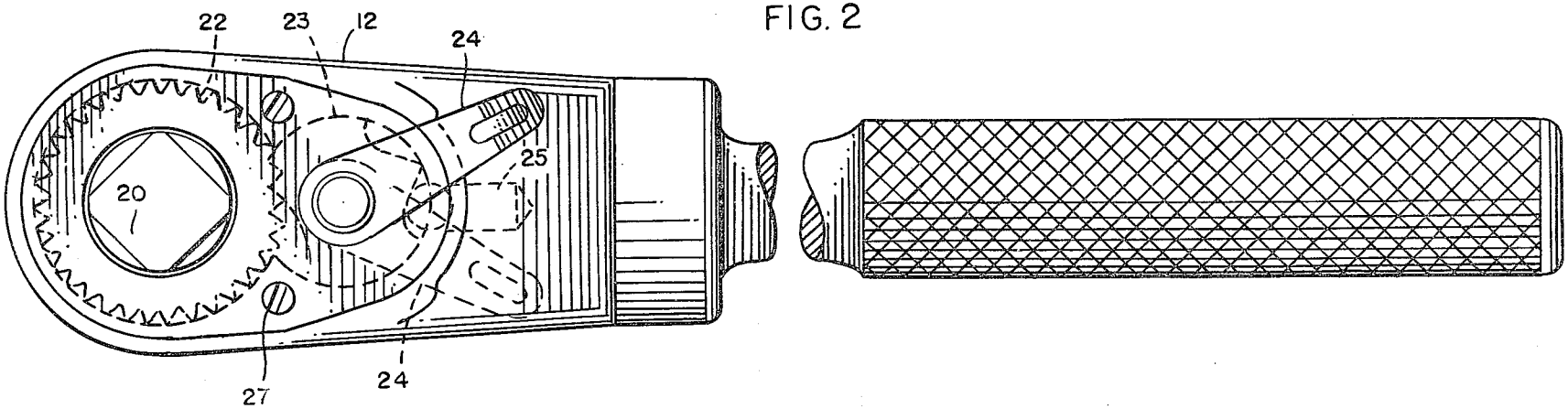
FIG. 2 is a bottom elevational view of the wrench.

Head housing 15 defines a chamber 18 having a cylindrical portion 18*a* for rotatably receiving end portion 11*b* of the handle (FIG. 1). Cavity 18 also includes a second portion 18*b* disposed at right angles to portion 18*a* for rotatably receiving drive member 19. The drive member includes a square lug portion 20 at its exposed lower end, a bevel gear portion 21 at its opposite end, and an enlarged sprocket or toothed wheel portion 22 intermediate its ends. The sprocket is engagable with a pawl 23 which is adjustable into either of two positions by means of an external selector level 24. When the lever is in the position shown in solid lines in FIG. 2, the pawl locks the sprocketed drive member in one direction so that as the handle 11 is oscillated the drive member will be rotated in a clockwise direction (when viewed from above) to tighten nuts or other work objects, whereas if the lever 24 is shifted into the other position depicted by broken lines in FIG. 2, oscillation of the handle will cause the drive member 19 to be rotated in a reverse or counterclockwise direction (when viewed from above) to loosen such work objects. A spring loaded detent 25 holds the pawl in each of its selected positions of adjustment. Since the detent, pawl, and drive member are all quite conventional in structure and operation, and are typically found in any standard reversible ratchet wrench, discussion of such elements in greater detail is believed unnecessary herein.

A suitable cover 26 may be secured to the underside of the head housing 15 by means of screws 27 (FIG. 2) threaded into openings 28 of the housing, or by any other appropriate connecting means.

A clutch and power-transmitting assembly 30 is located within the chamber 18 of head housing 15. Referring to FIG. 1, it will be observed that the clutch assembly is in fact almost completely encased within recess 13 in end portion 11*b* of the handle which is in turn received within the chamber 18 of the head housing. Consequently, the load-limiting clutch assembly is fully protected by both the handle and the head housing.

Figures 3, 4:
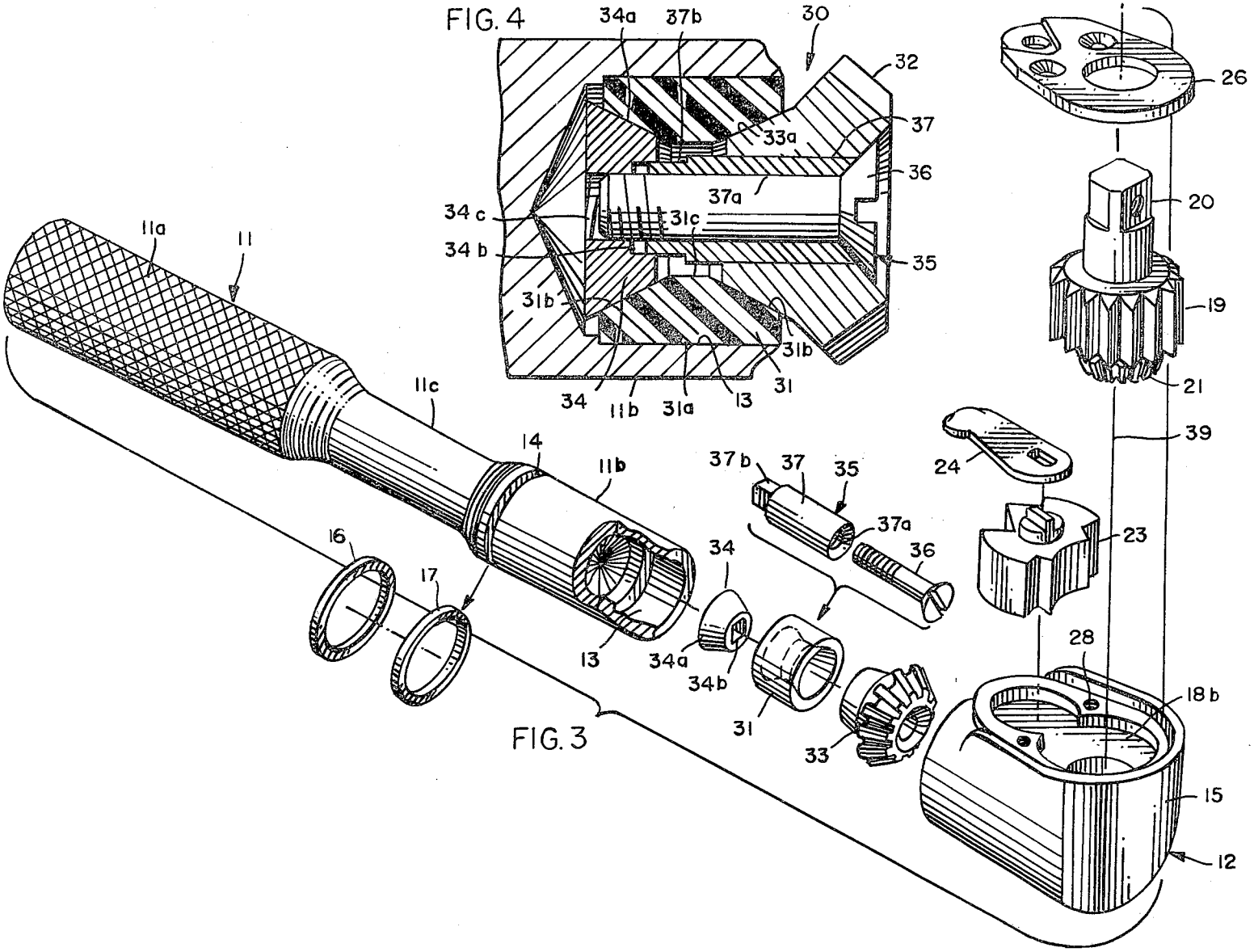
FIG. 3 is an exploded perspective view of the wrench.
FIG. 4 is an enlarged fragmentary longitudinal sectional view showing details of the clutch assembly.

The clutch assembly 30 consists essentially of a clutch sleeve 31 and a clutch body 32, the latter in turn being composed of a clutch gear 33, clutch nut 34, and connecting means 35. The clutch sleeve has a cylindrical outer surface 31*a* dimensioned to be received within cylindrical recess 13 of the handle, and has an axial bore defined by frusto-conical portions 31*b* tapering inwardly from opposite ends of the sleeve to join an intermediate central portion 31*c* (FIG. 4). Ideally, the sleeve is formed of a tough polymeric material such as nylon which is capable of limited expansion; however, other types of materials might conceivably be used.

Clutch nut 34 has a frusto-conical outer surface 34*a* which mates with one of the frusto-conical end surfaces of the sleeve. Similarly, clutch gear 33 has a frusto-conical outer surface 33*a* which mates with surface 31*b* at the opposite end of the sleeve. The clutch gear 33 and clutch nut 34 are maintained in coaxial relation with the sleeve 31 by means of connecting means 35, such connecting means also serving the additional purposes of locking the nut and gear against independent rotation while at the same time allowing limited axial adjustment of the spacing between such parts. Referring to FIGS. 3 and 4, it will be seen that the connecting means takes the form of a screw 36 and a tubular hub 37. The hub is secured to the clutch gear 33 by being test fitted therein; however, other means may be used to join the hub and gear together and, if desired, the two parts may even be formed integrally. In any event, the gear hub has a central bore 37*a* which rotatably receives the shank of screw 36. The end portion 37*b* of the hub projecting from the frusto-conical portion of the clutch gear 33 is non-circular (preferably square) in cross sectional outline and is slidably received within a square opening 34*b* extending inwardly from the reduced end of clutch nut 34. The nut is also provided with a threaded axial bore 34*c* for threadedly receiving the end of screw 36 (FIG. 4). Consequently, when the parts are assembled as shown, the tightening of screw 36 draws the coaxial clutch gear 33 and clutch nut 34 towards each other and into increasingly tight engagement with the frusto-conical inside surfaces of clutch sleeve 31. The outward force tends to cause radial expansion of the sleeve; however, such expansion is limited not only by the material from which the sleeve is formed but also by the close fit between the sleeve's outer surface and the cylindrical wall of recess 13. Consequently, tightening of screw 36 also has the effect of locking sleeve 31 in place within the recess 13 of handle 11.

It will be appreciated that relative rotation of the sleeve 31 and handle 11 may be insured against by forming one or both of the contacting surfaces so that rotational sliding movement is not possible even before tightening of screw 36. For example, surface 31*a* of the sleeve, as well as the opposing surface of the recess 13, might be splined, roughened, or formed in non-circular cross sectional configuration. As a practical matter, it has been found that if the handle is cast, and cavity 13 is not reamed or at least not polished, the surface of that cavity effectively prevents any relative rotation of sleeve 31 when screw 36 is tightened to cause limited expansion of that sleeve. Therefore, during operation of the wrench, the slipping action of the clutch will occur entirely between the frusto-conical surfaces of gear 33 and nut 34 and the mating frusto-conical surfaces of the clutch sleeve 31.

Should the cylindrical surface of handle recess 13 be polished, and especially if the frusto-conical surfaces of the sleeve 31, gear 33, and nut 34 are longitudinally grooved, roughened, or formed in non-circular cross sectional outline, the sleeve 31 may be assembled to rotate with the gear and nut, and the clutching/slipping action would then take place between the outer cylindrical surface 31*a* of the sleeve and the cylindrical surface of recess 13.

During fabrication of the wrench, screw 36 is tightened to achieve a preselected torque load limit. While adjustment of that limit by the user would not normally be anticipated, it is believed apparent that if retaining rings 16 and 17 are designed for ease of removability, or if some other means is selected for detachably securing the handle 11 and head housing 15 together, such adjustment may be readily effected. It will also be noted that even with the construction shown, a user may adjust the torque limit of the wrench by removing cover 26 and drive member 19 and then inserting a suitable right-angled screw driver into the cavity 18 of the head housing to loosen or tighten the adjustment screw.

The wrench is used in essentially the same manner as disclosed in my aforementioned U.S. Pat. No. 4,086,829. For example, if a nut is to be tightened by the wrench, the user first fits the nut upon the threaded end of the bolt, then engages the wrench with the nut in the usual manner, and then rotates handle 11 about its own longitudinal axis to cause limited tightening of the nut. As soon as the torque load limit is reached, further rotation of the handle will cause the clutch to slip, a fact which may be readily ascertained by tactile sensation through the handle. Final tightening of the nut is then accomplished by using the wrench in its conventional manner, oscillating the handle back and forth about the transverse axis (such axis being represented by line 39 in FIG. 3) of the wrench to rotate the drive member 19 and the nut to which it is coupled. As the handle swings in one direction to tighten the nut, the ratchet means secures the drive member against rotation with respect to the head assembly; as the handle swings in the opposite direction, such relative rotation is permitted and, as a result, rotational movement will be imparted to clutch gear 33 within the head housing 15. Rotational movement is not transmitted to handle 11, however, because of the slipping action of the clutch occasioned by the fact that the torque load limit is exceeded when the wrench is normally gripped and operated in its oscillatory mode.

While in the foregoing I have disclosed an embodiment of the invention in considerable detail for purposes of illustration, it will be understood by those skilled in the art that many of these details may be varied without departing from the spirit and scope of the invention.

I claim:

1. A speed handle ratchet wrench comprising an elongated handle and a head assembly at one end of said handle; said head assembly including a head housing rotatably receiving said one end of said handle for independent rotation of said handle about its longitudinal axis, a drive member carried by said housing for rotation about an axis transverse to said longitudinal axis, and housing for rotation of said drive member one way or the other about said transverse axis in response to oscillation of said handle; and a clutch assembly within said head housing coupling said handle and drive member for simultaneous rotation about said longitudinal axis and said transverse axis, respectively, only below a preselected torque load level; said clutch assembly including a clutch sleeve and a clutch body interposed between said handle and said drive member; said body operatively engaging said drive member and said sleeve being slidable relative to one of said handle and body when said preselected torque load level is exceeded; said sleeve being formed of tough but slightly deformable material and being provided with a bore defining at least one frusto-conical clutch surface; said body being disposed within said bore and frictionally engaging said clutch surface; said handle having an end portion defining a recess receiving said clutch assembly within said head housing; said sleeve having an outer surface secured to said handle within said recess.

2. The wrench of claim 1 in which said deformable material is a polymeric material.

3. The wrench of claim 1 in which said clutch body includes a bevel gear having a frusto-conical surface frictionally engaging said frusto-conical clutch surface of said sleeve.

4. A speed handle ratchet wrench comprising an elongated handle and a head assembly at one end of said handle; said head assembly including a head housing rotatably receiving said one end of said handle for independent rotation of said handle about its longitudinal axis, a drive member carried by said housing for rotation about an axis transverse to said longitudinal axis, and housing for rotation of said drive member one way or the other about said transverse axis in response to oscillation of said handle; and a clutch assembly within said head housing coupling said handle and drive member for simultaneous rotation about said longitudinal axis and said transverse axis, respectively, only below a preselected torque load level; said clutch assembly including a clutch sleeve and a clutch body interposed between said handle and said drive member; said body operatively engaging said drive member and said sleeve being slidable relative to one of said handle and body when said preselected torque load level is exceeded; said sleeve being formed of tough but slightly deformable material and being provided with a bore defining first and second frusto-conical clutch surfaces; said body being disposed within said bore and comprising a clutch gear, a clutch nut, and connecting means adjustably joining said clutch nut and gear through said sleeve; said clutch gear and clutch nut both defining frusto-conical surfaces frictionally engaging said first and second frusto-conical surfaces of said sleeve.

5. The wrench of claim 4 in which said connecting means locks said clutch gear and clutch nut against independent relative rotation while permitting limited axial adjustment of the same.

6. The wrench of claim 5 in which said connecting means comprises a screw extending between said clutch gear and clutch nut through said sleeve.

7. The wrench of claim 6 in which said connecting means includes a tubular hub through which said screw extends, said hub being provided by one of said clutch gear and clutch nut and having a non-circular projecting end portion slidably received in a non-circular opening in the other of said clutch gear and clutch nut.

8. The wrench of claim 4 in which said deformable material is a polymeric material.

* * * * *